United States Patent [19]

Beers

[11] 4,325,302

[45] Apr. 20, 1982

[54] APPARATUS FOR PRINTING AND APPLYING PRESSURE SENSITIVE LABELS

[75] Inventor: Eugene W. Beers, Lafayette, Calif.

[73] Assignee: Esselte Pendaflex Corp., Garden City, N.Y.

[21] Appl. No.: 88,847

[22] Filed: Oct. 29, 1979

[51] Int. Cl.[3] ..... B41J 1/20

[52] U.S. Cl. ..... 101/288; 101/111; 101/295; 101/316; 101/321; 156/384; 101/326; 101/359; 226/143; 226/157

[58] Field of Search ..... 101/288, 110, 111, 109, 101/291, 292, 295, 316, 318, 321, 326, 348, 359; 226/148, 149, 157, 147; 400/174, 175; 156/384

[56] References Cited

U.S. PATENT DOCUMENTS

| | | | |
|---|---|---|---|
| 741,520 | 10/1903 | Mankiewicz | 101/111 |
| 940,186 | 11/1909 | Otteson | 101/111 |
| 1,968,900 | 8/1934 | Nangler | 101/110 |
| 3,878,929 | 4/1975 | Orlens et al. | 400/175 |
| 3,951,061 | 4/1976 | Bremmer, Jr. et al. | 101/288 |
| 4,041,863 | 8/1977 | Mullen et al. | 101/288 |
| 4,055,118 | 10/1977 | Sato | 101/110 |
| 4,075,944 | 2/1978 | Conley | 101/288 |
| 4,096,800 | 6/1978 | Kistner et al. | 101/111 |
| 4,125,074 | 11/1978 | Sato | 101/288 |
| 4,207,131 | 6/1980 | Hamisch, Jr. | 101/288 |
| 4,271,759 | 6/1981 | Volk | 101/110 |
| 9,044,677 | 8/1977 | Hamisch, Jr. | 101/295 |

FOREIGN PATENT DOCUMENTS

| | | | |
|---|---|---|---|
| 167037 | 4/1950 | Austria | 101/111 |

*Primary Examiner*—William Pieprz

*Attorney, Agent, or Firm*—Gerald J. Ferguson, Jr.; Joseph J. Baker

[57] ABSTRACT

Apparatus for printing and applying pressure-sensitive labels carried on a release liner of supporting material where the label stock advancement mechanism is a feed wheel which advances the release liner. A brake prevents movement of the label stock during application of a label. A ratchet and pawl arrangement incrementally advances the feed wheel each time a hand lever is returned to its rest position. At the same time, a second ratchet and pawl arrangement is effective to remove the brake during the incremental label stock advancement. The feed and brake release ratchets are preferably integrally connected to opposite sides of the feed wheel. Mechanisms are also provided for ensuring removal of the brake prior to incremental label stock advancement and for manually latching the brake in its released position during loading of label stock in the apparatus.

An inking roller mechanism for the apparatus print head includes a latching mechanism which in a first position latches the ink roll in place and in a second, non-latching position permits removal and replacement of the ink roll without tools. Further, the print head construction is such that one of a different number of print heads may be secured into the apparatus, again without tools. Further, the print head includes a plurality of print bands mounted on upper and lower drive gears where the lower drive gears are hexagonal in shape. A selector shaft which may be shifted to a selected print band and then rotated to rotate the print band to a selected position includes a selector shaft detenting means which detents the shaft close to the axis thereof.

25 Claims, 8 Drawing Figures

APPARATUS FOR PRINTING AND APPLYING PRESSURE SENSITIVE LABELS

BACKGROUND OF THE INVENTION

This invention relates to labellers for printing and applying pressure sensitive labels carried on a release liner of supporting material.

Such labelers are used, for example, in grocery stores or the like where labels printed with pricing information and the like are applied to various objects.

There are a number of known labellers, most of which tend to be complicated and accordingly expensive and difficult to maintain. Since labellers are used on a continuing basis, it is desirable not only that the tools be simple in construction and economical in cost but also reliable in use.

SUMMARY OF THE INVENTION

Accordingly, it is a primary object of this invention to provide an improved labeller for printing and applying pressure sensitive labels which is simple in construction and low in cost yet which is reliable in use.

It is a further object of this invention to provide a labeller of the above type including improved braking means for preventing movement of the label stock during application of a label to an object.

It is a further object of this invention to provide improved braking means of the above type which includes means for removing the brake during incremental advancement of label stock through the labeller.

It is a further object of this invention to provide improved brake means of the above type which includes means for removing the brake prior to the incremental label advancement.

It is a further object of this invention to provide braking means of the above type which includes means for manually removing the brake to facilitate loading of label stock through the labeller.

It is a further object of this invention to provide a labeller of the above type having an improved ink roller mechanism for inking the type elements employed in the labeller.

It is a further object of this invention to provide an improved ink roller mechanism of the above type wherein the ink roller thereof may be readily removed and replaced without tools.

It is a further object of this invention to provide an improved labeller of the above type having a print head wherein any one of a number of different print heads may be securely attached to the labeller without tools so that, for example, attachment of the print head can be made after a customer's order has been received.

It is a further object of this invention to provide an improved print head of the above type which may be easily, securely attached to a labeller without tools.

It is a further object of this invention to provide a labeller of the above type having a printing mechanism which includes a plurality of print bands and which includes improved means for increasing the amount of pre-load which can be placed on the bands.

It is a further object of this invention to provide an improved print head of the above type wherein a selector shaft is axially shiftable to select a particular print band for movement thereof and which includes improved means for detenting the selector shaft.

Other objects and advantages of this invention will be apparent from a reading of the following specification and claims taken with the drawing.

DETAILED DESCRIPTION OF PREFERRED EMBODIMENTS

Figure 1:
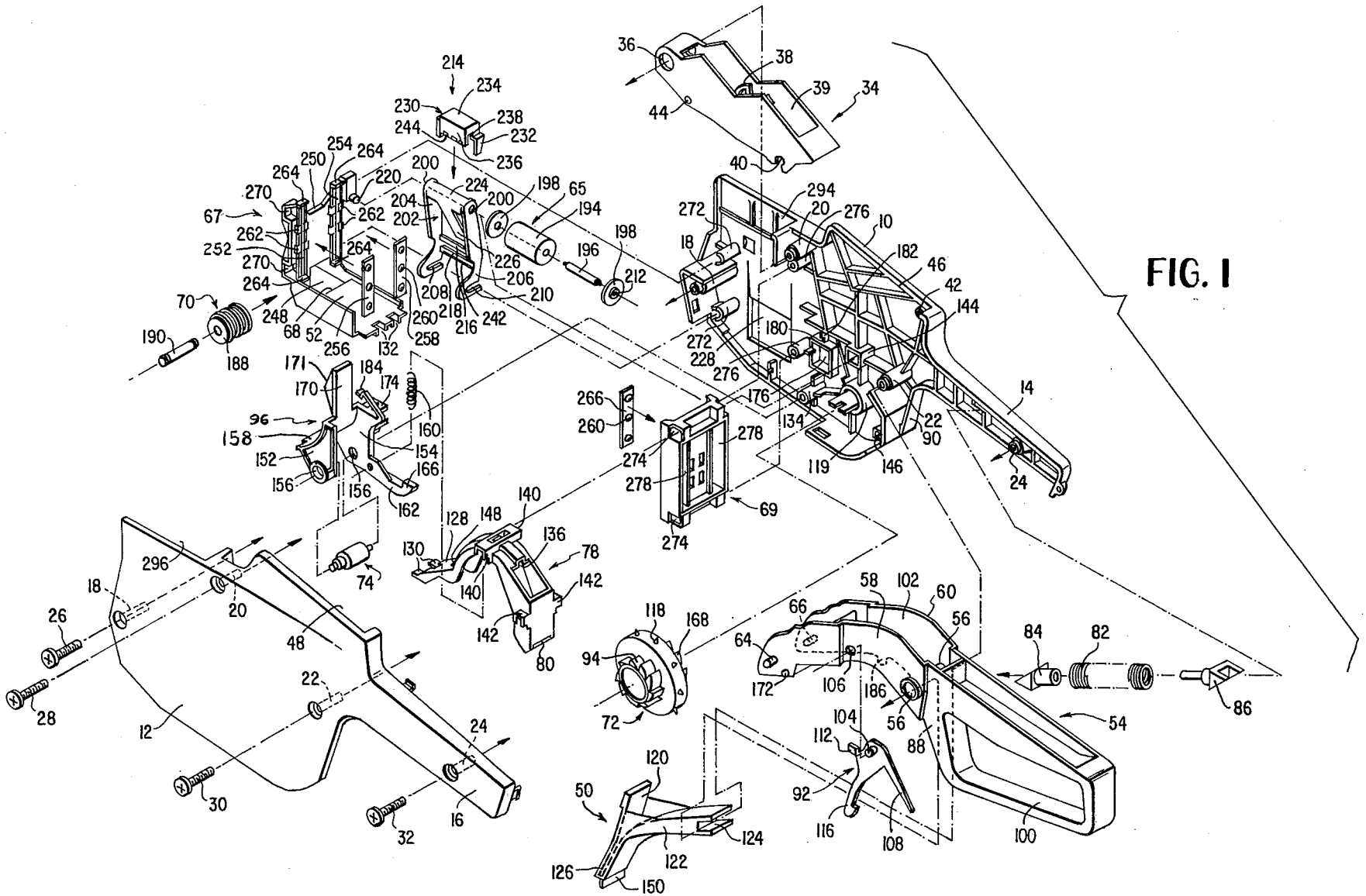
FIG. 1 is an exploded perspective view of an illustrative labeller in accordance with the invention without the print head.

Reference should be made to the drawing where like reference numerals refer to like parts.

Figure 2:
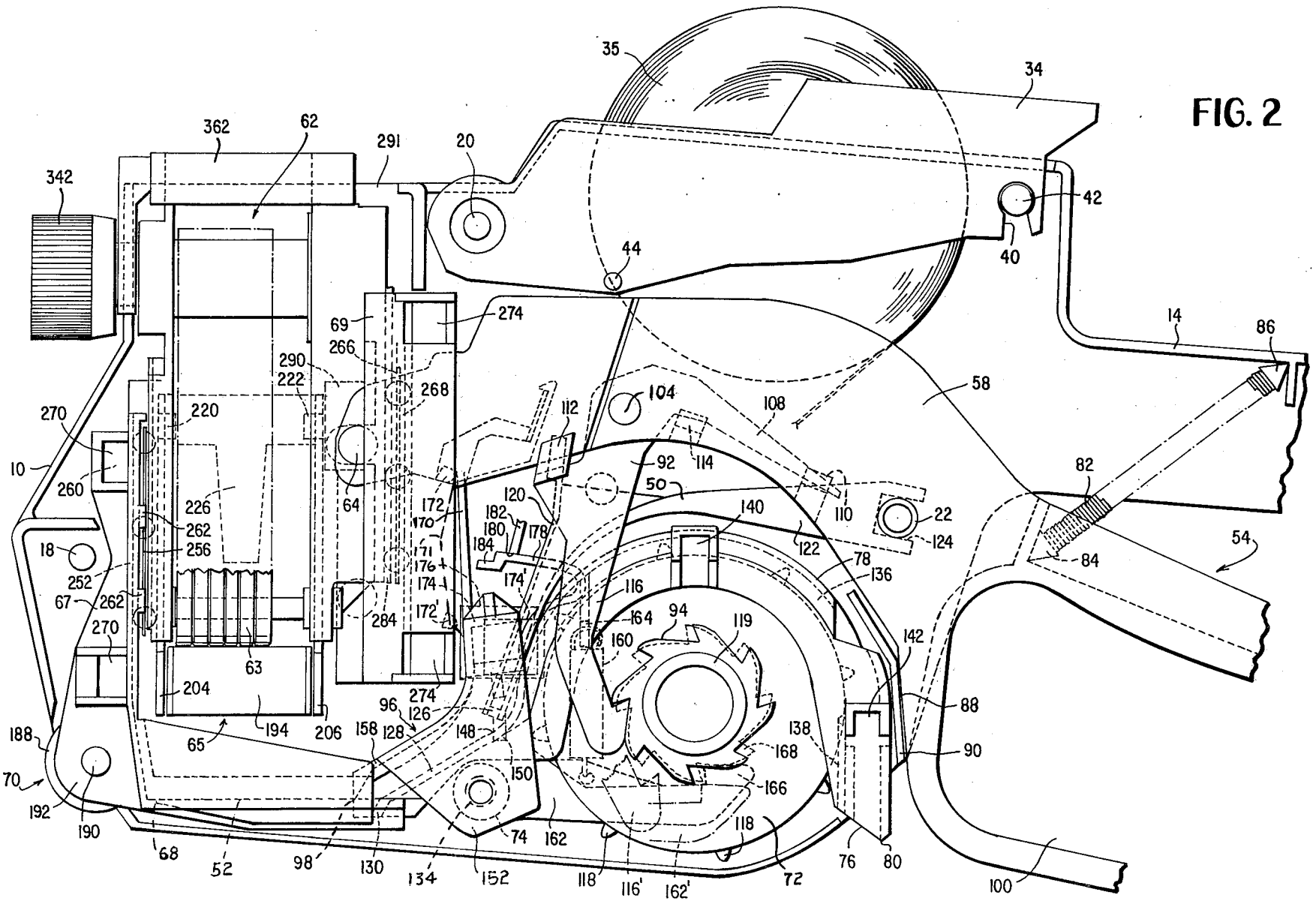
FIG. 2 is a side elevation view of the labeller of FIG. 1 including the print head with the left side plate removed.

Referring to FIGS. 1 and 2, the hand labeller of this invention comprises a casing including a right side plate 10 thereof and a left side plate 12 between which are mounted the component parts of the labeller. Both side plates include rearwardly extending handle portions 14 and 16 and tubular projections 18, 20, 22 and 24 where the projections 18–24 of side plate 10 are internally threaded to receive screws 26–32 to thereby effect engagement of the side plates.

A label stock holder 34 is provided for mounting a roll of label stock 35 which typically comprises a plurality of sequentially disposed, pressure sensitive labels adhesively adhered to a release liner as is known in this art. The label stock is directed from the holder through an upper chute 50 to an anvil 52 where the labels are sequentially printed with each actuation of a hand lever 54 which is pivotally mounted with respect to the casing. Attached to the forward end of the hand lever is a print head 62 (see FIGS. 2 and 6) which reciprocates within front and rear print head frames 67 and 69. The print head includes a plurality of movable print elements 63 which are inked by an ink roller mechanism 65. When hand lever 54 is squeezed counterclockwise, the print head is brought into contact with a label positioned on anvil 52 to effect printing thereof.

Forward edge 68 of anvil 52 constitutes a peel edge at which point the labels are successively peeled from the release liner. The peeled labels may then be dispensed by an applicator roller 70 to an object to indicate, for example, the price thereof. The release liner reverses its direction at peel edge 68 and passes under anvil 52 to a feed wheel 72 via an idle roller 74. The release liner passes over the feed wheel and is then fed from the casing out of a rearward opening 76 in a lower chute 78 having a release liner tear edge 80.

As stated above, printing of the labels occurs each time hand lever 54 is squeezed. Incremental advancement of the label stock through the tool occurs each time the hand lever is released. A compression spring 82 disposed on mounts 84 and 86 extending between the hand lever 54 and handle portions 14 and 16 returns the lever to its rest position shown in solid lines in FIG. 2 where an abutment surface 88 of the lever engages a rear surface 90 of the casing. During the return movement of the lever, a pawl 92 pivotally connected to the hand lever engages a circular ratchet 94 on feed wheel 72 to clockwise advance the feed wheel a predetermined distance corresponding to the length of one label. Thus, after each label is printed, it is advanced to applicator roller 70 where the rear edge of the label remains adhered to the release liner until it is applied to the object. The next label to be printed is positioned over anvil 52 and aligned with the print head 62. To maintain this alignment during dispensing of the printed label by applicator 70, a brake 96 is provided which includes a pointed edge 98 (see FIG. 2) which engages the label stock during dispensing thereof.

Having generally described the component parts of the labeller and the relationship thereof with respect to the incrementally advanced label stock, the component parts will now be described in more detail.

LABEL STOCK ADVANCEMENT MECHANISM

Label stock holder 34 includes an opening 36 in the forward end thereof for pivotally mounting the holder around tubular projections 20 and a spool 38 for mounting the roll in an opening 39 extending through the holder. Recessed portions 40 are provided at the rearward end of the holder which engage lugs 42 formed in side plates 10 and 12 when holder 34 is lowered into its operative position. The recesses 40 expand slightly in engaging the lugs 42 to effect a releasably secure engagement of the holder with respect to the casing. Holder 34 also includes knobs 44 which hold holder 34 in its raised, loading position, the knobs 44 resting against the upper surfaces of side plates 10 and 12. As can be seen in FIG. 1, the side plates have cut-out portions 46 and 48 which constitute an opening through which holder 34 can be raised and lowered. When lowering the holder into the casing, the sides thereof are inwardly depressed to permit knob 44 to pass through the opening.

As stated above, the label stock is incrementally advanced a distance corresponding to the length of one label each time the hand lever 54 is returned to its rest position by spring 82. Hand lever 54 includes a grip portion 100 and a forwardly extending portion 102 which includes side plates 58 and 60. Openings 56 in these side plates permit pivotal mounting of the hand lever on tubular projections 22. Pawl 92 is provided with a lug 104 which is rotatably mounted in an opening 106 in side plate 58. As can be seen in FIG. 2, the pawl includes a resilient finger 108 which engages the underside of a lug 110 provided on the inside surface of side plate 58. A lug 112 provided on the pawl and a second lug 114 provided on the inside surface of plate 58 assist in maintaining the pawl in place with respect to side plate 58. The pawl also includes a downwardly extending finger 116 which normally engages, due to the bias of resilient finger 108, one of the teeth of circular ratchet 94 which is preferably integrally connected to feed wheel 72. Thus, when hand lever 54 is squeezed to its raised position, finger 116 is lowered to its dotted line position 116' shown in FIG. 2. When the hand lever is released to its solid line position, the finger engages the next tooth of the ratchet to incrementally advance the feed wheel as the finger returns to its solid line position. The feed wheel is provided with a plurality of circumferentially disposed lugs 118 which pierce prefabricated cuts in the release liner to effect advancement thereof, the feed wheel being rotatably mounted on a tubular projection 119 on side plate 10 which engages a corresponding tubular projection, not shown, on side plate 12.

As the label stock is drawn from roll 35, it is first directed through upper chute 50 which includes an upper plate 120 and a lower plate 122. The width of the upper plate 120 approximately corresponds to the inside distance between plates 58 and 60 of hand lever 54. The lower plate 122 includes a recessed portion 124 which is mounted upon tubular projection 22 to thus assist in the mounting of the chute within the labeller. An opening 126 at the bottom of the chute, where plates 120 and 122 are relatively close to one another is provided through which label stock is advanced and directed toward anvil 52.

After leaving opening 126 the label stock is directed onto an upper surface 128 of lower chute 78. Lower chute 78 includes a pair of fingers 130 which engage recesses 132 provided at the forward edge of anvil 52 whereby a substantially continuous connection is provided between surface 128 and the upper surface of the anvil to thereby provide a smooth path for the label stock to the anvil. After the release liner reverses its direction at peel edge 68, it passes beneath idle roller 74 which is rotatably mounted inside bearings 134 provided on side plates 10 and 12. The prefabricated cuts in the release liner are then engaged by lugs 118 of feed wheel 72, the liner passing between the lower surface of chute 78 and the outer circumference of the feed wheel. Chute 78 is provided with a relief portion 136 so that lugs 118 may pass therethrough, inasmuch as the clearance between the outer circumference of the feed wheel and the upper inside surface of chute 78 is preferably quite small such as 0.020 inches, for example. At the rearward end thereof, chute 78 includes a peel finger 138 which peels the release liner from the feed wheel and directs it out opening 76 of the chute. Excessive release liner extending out of the casing may be removed at tear edge 80, also formed at the rearward portion of the chute. Lower chute 78, in addition to being mounted with respect to anvil 52 by fingers 130, is also mounted between side plates 10 and 12 via projections 140 and 142 which non-rotatably engage lugs 144 and 146 respectively in the side plates. Surface 128 of chute 78 is also provided with an opening 148 through which extends a projection 150 of upper chute 50 to thereby further facilitate the mounting of the upper chute within the labeller.

Applicator 70 includes an applicator roll 188 which is rotatably mounted on a pin 190 which extends between the forward portions 192 of front print head frame 67 as shown in FIG. 2. The applicator is thus so positioned with respect to the peel edge 68 of anvil 52 that the peeled labels project under roll 188 preparatory to dispensing thereof. As is known in this art, dispensing of the labels occurs when the operator rolls roll 188 across an object whereby the peeled label is separated at its rear edge from the release liner and applied to the object.

BRAKE MECHANISM

As stated above, brake 96 holds the label stock in place during application of a label by applicator 70 to thereby facilitate alignment of the labels with respect to print head 62. The brake comprises first and second side plates 152 and 154, the side plates having openings 156 extending therethrough so that the brake is rotatably mounted on the outer surface of bearings 134 independently of idle roller 74 which is mounted on the interior surface of these bearings as stated above. The distance between side plates 152 and 154 approximately corresponds to the distance between side plates 58 and 60 of hand lever 54. Extending forwardly and downwardly from the side plates is the brake portion 158. As shown in FIG. 2, pointed edge 98 extends downwardly from brake portion 158 and normally holds the labels against the rear portion of anvil 52 due to the bias exerted by a spring 160. The spring is connected between a pawl 162 which extends from side plate 154 of the brake and a lug 164 disposed on the upper, rear surface of lower chute 78.

In accordance with one aspect of the invention, pawl 162 is provided with a latching portion 166 which engages ratchet 168 preferably integrally connected to the rear side of feed wheel 72. The brake pawl with its latching portion performs two functions, the first of which is to prevent back up of feed wheel 72 as feed pawl 92 is lowered from its solid line to its dotted line position shown in FIG. 2. That is, since the pawl 92 is biased against the feed wheel by resilient finger 108, there might be a tendency for the pawl to back up the feed wheel as it is lowered. However, since pawl 162 and its associated latching portion 166 act as an anti-back up device, this is prevented. A further function of pawl 162 is that of removing the brake from the label stock to thereby permit advancement thereof. Thus, as the feed wheel is advanced by pawl 92, one of the teeth of ratchet 168 will depress pawl 162 to its dotted line position 162' shown in FIG. 2 whereby the brake will be clockwise rotated away from label stock.

In accordance with another aspect of the invention, in order to ensure removal of the brake prior to incremental advancement thereof by the feed wheel, the brake is provided with an upwardly extending projection 170 which includes forwardly extending portion 171. When hand lever 54 is in its solid line position as shown in FIG. 2, projection 170 engages at its upper extremity a bar 172 which extends between the side plates 58 and 60. When the handle lever is squeezed, the bar 172 rides along portion 171 and assumes the position 172' shown in FIG. 2 to thereby rotate the brake clockwise away from the label stock. Thus, the brake is removed as the hand lever is squeezed. Since incremental advancement of the label stock occurs during the return of the hand lever to its rest position, the brake is removed well before advancement occurs. As the lever is returned to its rest position, the brake removal effected by the interaction of projection 170 and bar 172 begins to terminate. However, by this time the brake removal effected by the interaction of ratchet 168 with the latching portion 166 of pawl 162 becomes effective to maintain removal of the brake from the label stock. After the label stock has been incrementally advanced, pawl 162 is returned to its solid line position shown in FIG. 2. The brake is now effective to maintain the label stock in place as a label is applied with applicator 70.

Figure 3:
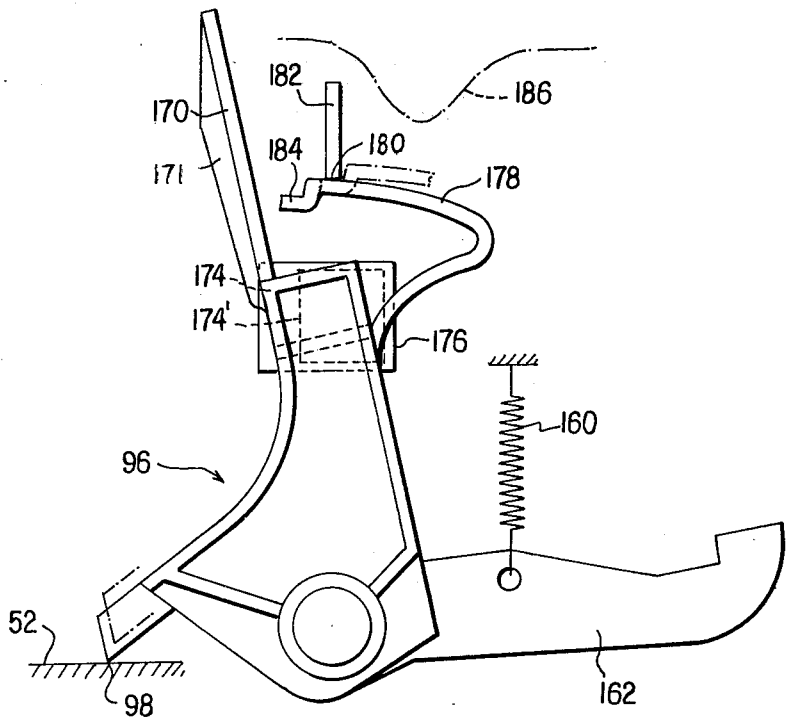
FIG. 3 is a side elevation view of the brake mechanism of FIG. 1 which illustrates the manual release feature thereof.

When label stock is initially loaded into the labeller by threading the label stock through its intended path of travel, brake 96 must be raised from anvil 52 in order to facilitate threading of the label stock over the anvil. Thus, in accordance with a further aspect of the invention, brake 96 is provided with a projection 174 which horizontally extends from side plate 154 through an opening 176 in casing side plate 10 as indicated in FIGS. 2 and 3. The brake is also provided with a curved resilient arm 178 which extends upwardly from side plate 154 and which is spring loaded against a notch 180 formed in a rib 182 of side plate 10. Resilient arm 178 includes a latch portion 184. Also provided on side plate 60 of hand lever 54 is a downwardly extending projection 186 which is aligned with resilient arm 178 to facilitate engagement therewith.

In normal operation, the brake is in the solid line position shown in FIG. 3 except when temporarily raised from anvil 52 to permit incremental advancement of the label stock as described above. In order to latch the brake above the anvil to provide clearance for loading label stock, the operator manually pushes extension 174 to the dotted line position 174'. Due to the resilience of arm 178, latch portion 184 will spring into the dotted line position shown in FIG. 3 behind body rib 182 whereby the brake edge 98 is raised to and latched in its dotted line position with respect to anvil 52. The brake will remain in this latched position until the first squeeze of hand lever 54. At this time, the protrusion 186 on hand lever side plate 60 will be moved downwardly until it engages arm 178 to thereby release the arm from the latch. Spring 160 will then counterclockwise rotate brake 96 to its solid line position so that the brake now engages the loaded label stock.

INK ROLLER MECHANISM

Figure 4:
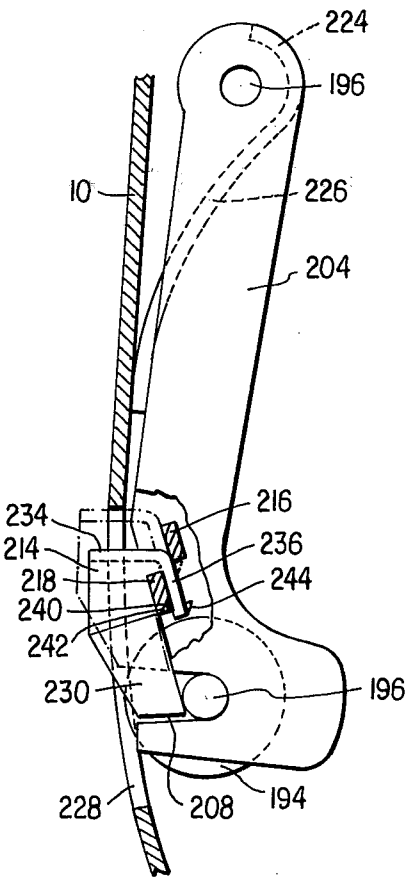
FIG. 4 is a side elevation view of the ink roller mechanism of FIG. 1 which illustrates the ink roll removal and replacement feature thereof.

As shown in FIGS. 1, 2 and 4, ink roller 65 includes an ink roll 194 which is rotatably mounted on a shaft 196, the shaft being journaled in openings in a pair of end caps 198. A carrier 202 for the ink roller 194 includes side plates 204 and 206 which are recessed at the lower ends thereof at 208 and 210. End caps 198 are provided with tubular projections 212 which are inserted into the recesses 208 and 210 to thereby mount ink roller 194 in carrier 202. In order to releasably latch the ink roller into the carrier, a latch 214 is provided which is mounted with respect to bars 216 and 218 extending between side plates 204 and 206.

At the upper end of side plates 204 and 206 are openings 200 which are respectively rotatably mounted on bearings 220 and 222 on front and rear print head frames 67 and 69. A semicircular support 224 extends between the upper ends of side plates 204 and 206 and downwardly depending therefrom is a resilient finger 226 which is loaded against side plate 10 as shown in FIG. 4 so that the ink roller follows the movement of print head 62. When the print head is in its raised position, the ink roller contacts the type elements 63 as shown in FIG. 2. As the print head is lowered toward anvil 52, the ink roller carrier 202 swings out of the print head path of movement toward side plate 10. As it does, ink roll 194 inks the type elements. It is then returned to its FIG. 2 position by resilient finger 226 when the print head is once again raised.

In accordance with another aspect of the invention, ink roll 194 may be readily replaced without tools. Accordingly, an opening 228 is provided in casing side plate 10 through which the ink roll may be removed from recesses 208 and 210 and replaced. In particular, latch 214 includes side plates 230 and 232 and an upper plate 234 which connects the side plates. A projection 236 extends downwardly from the rear edge of upper plate 234 so that recesses 238 are formed in the side plates. Thus, as shown in FIG. 4, latch 214 is slideably mounted on bar 218, the bar being disposed within the recessed portions 238. In order to slideably position latch 214 in either its ink roller latching position shown in solid lines in FIG. 4 or in its ink roller removal position shown in dotted lines, a detenting surface 240 is provided on the lower, inner surface of downwardly extending projection 236. This detenting surface may comprise a plurality of rounded protrusions. Also provided on the lower inner surface of bar 218 is a recessed portion 242 (also see FIG. 1) in which the detenting surface 240 rests when the latch is in its solid line, ink roller latching position. In order to remove the latch from the ink roller, the operator places his finger underneath upper plate 234 and pushes the latch upwardly to its dotted line position. Provided on the outer, lower edge of downwardly extending projection 236 is a stop 244 which may comprise a series of pointed projections as shown in FIG. 1. These projections engage the lower edge of bar 216 while the detenting members 240 rest on the upper edge of bar 218 when the latch is in its dotted line, ink roller removal position. As can be seen, the lower edge of the latch is above recesses 208 and 210 so that the ink roller may be shaken out through opening 228 and replaced. Due to the soft, resilient, plastic material comprising latch 214, the latch may then be snapped down to lock the ink roller in position. As can be appreciated, no tools are required.

PRINT HEAD AND SUPPORT THEREFOR

Figure 6:
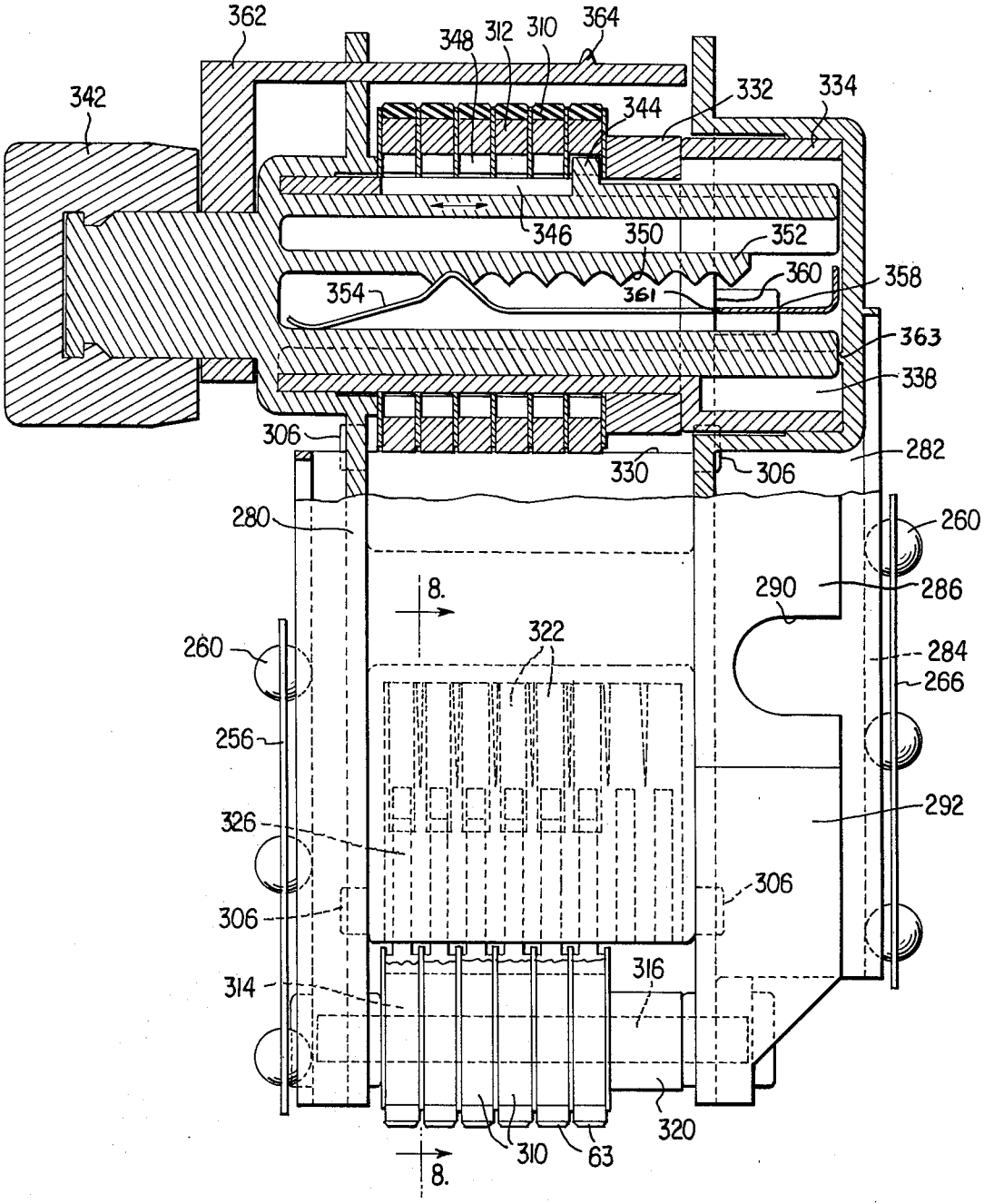
FIG. 6 is a side elevation view of the print head of FIG. 5.

Referring to FIGS. 1, 2 and 6, the support for print head 62 comprises front and rear print head frames 67 and 69. Front frame 67 includes anvil 52 with its peel edge 68. Mounted on the lower forward portion of frame 67 is applicator roller 70, there being an opening 248 between peel edge 68 and roller 70 whereby the peeled labels pass from the upper surface of anvil 52 beneath roll 188.

Also disposed at the forward end of frame 67 is an upwardly extending plate 250 to which is integrally connected rearward facing raceways 252 and 254. Disposed within these raceways are ball retainers 256 and 258 respectively. Each of the retainers incorporates a plurality of rotatably mounted balls 260 in a known manner. The retainers 256 and 258 are held in the raceways by fingers 262. Stop surfaces 264 are provided at the upper and lower ends of the raceways to restrict vertical movement of the retainers within the raceways. A similar ball retainer 266 is mounted in a centrally disposed, forward facing raceway 268 in rear frame 69.

Plate 250 of front frame 67 is also provided with a pair of upper and lower recesses 270 at each side thereof, these recessed portions being mounted on lugs 272 extending from the side plates 10 and 12. Rear print head frame 69 is similarly mounted in that a pair of upper and lower recesses 274 are provided at each side thereof, the recessed portions being mounted on lugs 276 on side plates 10 and 12. In order to facilitate connection of hand lever 54 to print head 62, a pair of rectangular openings 278 extend through rear frame 69. Through these openings, the respective forward portions of side plates 58 and 60 extend as indicated in FIG. 2. Mounted at these forward portions are lugs 64 and 66 which are adapted to engage the print head.

Figure 5:
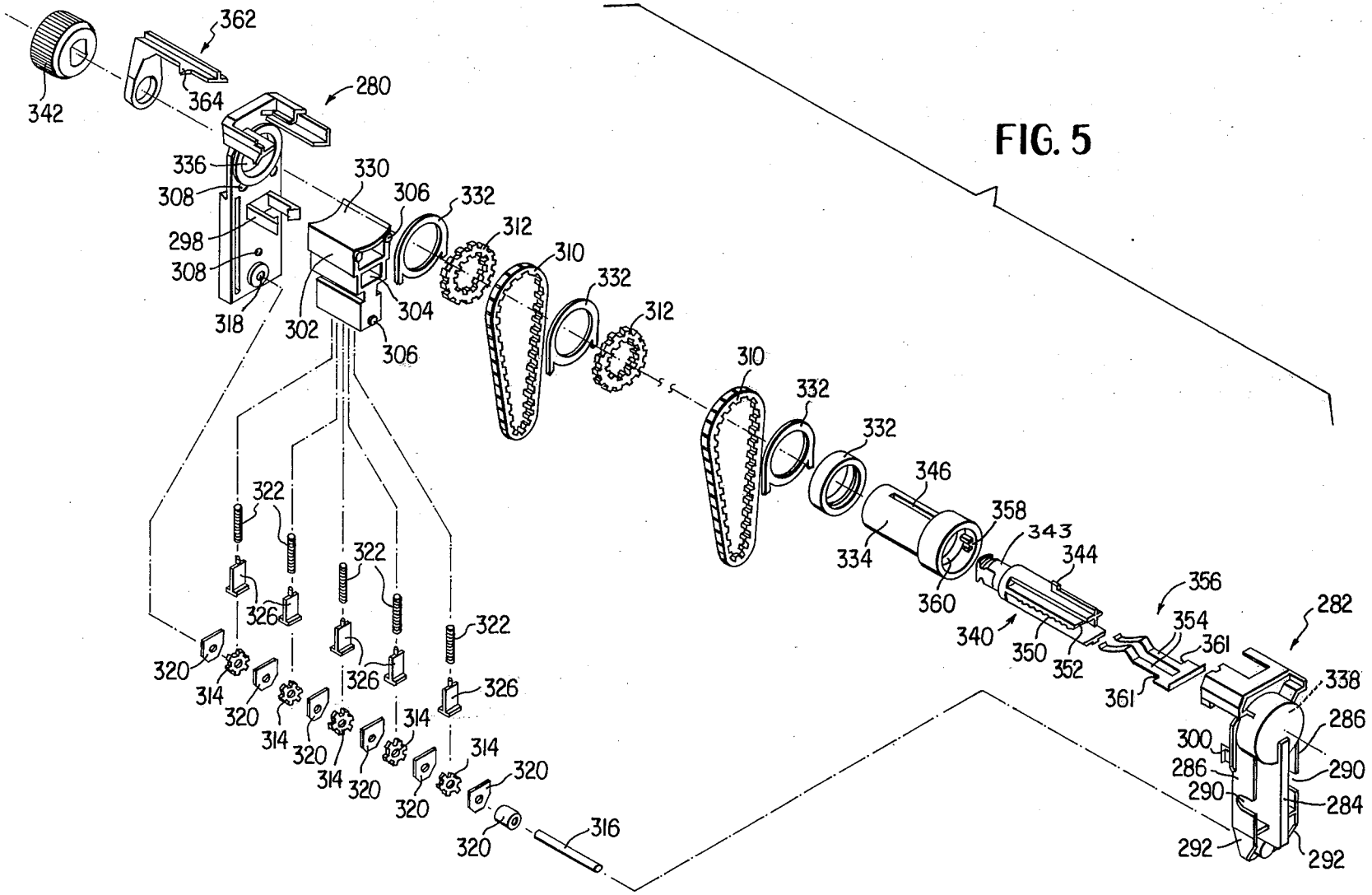
FIG. 5 is an exploded perspective view of an illustrative embodiment of a print head in accordance with the invention.
Figure 7:
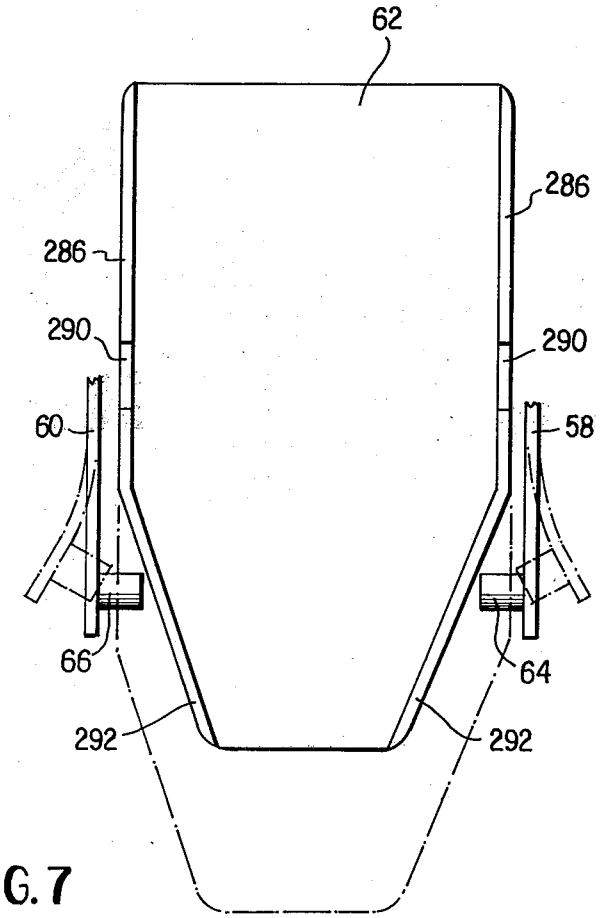
FIG. 7 is a front elevation view of the print head of FIG. 6 illustrating the attachment thereof to the labeller.

Referring to FIGS. 5 and 6, print head 62 includes front and rear head cover 280 and 282. As can be seen in FIG. 5, the rear head cover includes a centrally disposed, rearward facing raceway 284, there being two similar, forward facing raceways (not shown) disposed at the outer edges of front head cover 280. The balls 260 of retainers 256, 258 and 266 engage these raceways to permit reciprocal vertical movement of the print head between the front and rear frames 67 and 69. Rear head cover 282 includes a pair of side plates 286 having notches 290. As can best be seen in FIGS. 5 and 7, the lower portions of side plates 286 are inwardly tapered at 292 to thereby facilitate engagement of print head 62 with the forward portion of hand lever 54. In particular, in accordance with a further aspect of the invention, an opening 291 is formed in the upper surface of the casing by cut-out portions 294 and 296 in side plates 10 and 12. In fabricating a labeller, a selected one of a plurality of different kinds of print heads may be inserted through opening 291 and then connected to hand lever 54. As a print head is lowered through opening 291, the tapered surfaces 292 of rear head cover 282 engage and spread apart lugs 64 and 66 of the hand lever as indicated in FIG. 7. As the print head is pushed further into the casing, the spread apart lugs 62 and 64 shown in dotted lines will slide along the outer surfaces of side plates 286 until they encounter notches 290 at which time, they will snap into the notches to thereby establish a secure, essentially permanent connection between the hand lever and print head. The side plates 58 and 60 of the hand lever are preferably made of a relatively soft, resilient, plastic material to facilitate the spreading thereof as the print head is inserted into the labeller.

The foregoing feature of the invention is advantageous in that a print head need not be incorporated into the labeller until, for example, an order is placed for a labeller having a particular kind of print head. Thus, there may be kept in inventory print heads capable of printing either 5, 6 or 8 digits of information per line where one or more lines may be printed. If a customer orders 6 digit, one line labellers, the appropriate print heads may then be incorporated in the labeller in the manner described above to fill the order. In this manner, it can be seen the number of labeller bodies required for different customers' needs can be minimized while at the same time a capability is provided of immediately satisfying a wide range of customer requirements.

Figure 8:
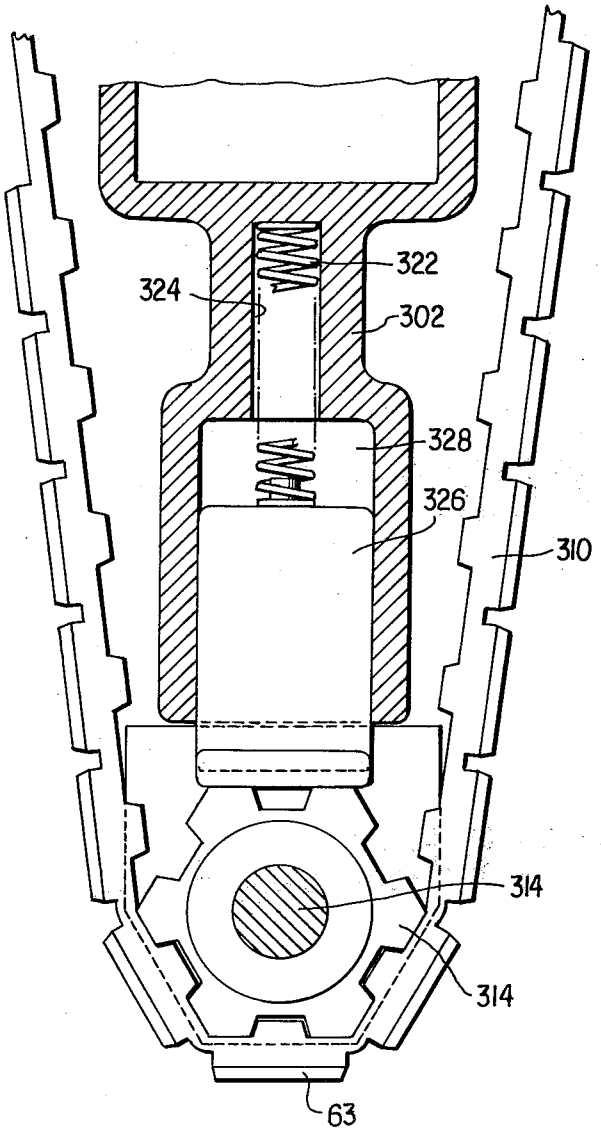
FIG. 8 is a cross-sectional view along the line 8—8 of FIG. 6 illustrating the hexagonal lower drive gears for the head print bands.

Front head cover 280 includes an expandable fastener 298 which engages forked projections 300 on rear cover 282 to connect the covers with one another. Disposed between the covers is a body 302 having an opening 304 through which fastener 298 extends. Disposed on each side of body 302 are lugs 306 which are inserted in openings 308 on the interior surfaces of covers 280 and 282. A plurality of print bands 310 are mounted on annular upper drive gear wheels 312 and hexagonal lower drive gear wheels 314. The hexagonal shape of gear wheels 314 can be seen in FIG. 8. In accordance with a further aspect of the invention, gear wheels 314 are hexagonal in shape in order that more pre-load can be placed on the print bands. The distance from the center of the gear to a corner is less in a hexagonal shape than in a square one. Thus, the band doesn't have to stretch as much when a particular character is being selected for printing.

The lower gear wheels are mounted on a shaft 316 journaled in openings 318 in the lower portions of head covers 280 and 282. Also disposed on shaft 316 are spacers 320. The gear wheels are spring loaded by springs 322 mounted in upper recesses 324 in body 302. The other ends of these springs are mounted on detents 326 which are slideably mounted in lower recesses 328 in body 302 where upper recesses 324 communicate with lower recesses 326 as can best be seen in FIG. 8.

Disposed between drive gears 312 are annular spacers 332. A sleeve 334 extends through the gears 312 and is rotatably mounted in an opening 336 in front cover 280 and a recess 338 in cover 282, the sleeve not being capable of axial movement.

In order to move a desired character on one of the print bands 310 into the print field, a selector shaft 340 is provided which extends through sleeve 334 and which has a knob 342 connected to the forward end 343 thereof. A driving lug 344 extends through a slot 346 in sleeve 334 as can best be seen in FIG. 6 and engages one of the inner teeth 348 of one of the annular drive gears 312. Thus, by rotating knob 342 a selected print band 310 can be moved to position a desired character into the print field. As is known, the print bands may be provided with interior teeth which engage the exterior teeth of drive wheels 312 and 314. Further, they are provided with print elements 63 at the lower portions thereof and with corresponding display elements at the upper portions thereof so that the selected character may be viewed from above.

In accordance with a further aspect of this invention, an improved means for detenting selector shaft 340 at a particular print band 310 is employed. The selector shaft 340 is axially slideable within sleeve 334 to permit positioning of lug 344 with respect to a desired one of the print bands. Once the lug 344 has engaged one of the interior teeth 348 of the drive gear 312 corresponding to the desired print band, the selector shaft 340 rotates with sleeve 334 as the desired character is being positioned in the print field. In order to detent the selector shaft at the desired print band, a pair of racks 350 are provided on opposite sides of the lower surface of an interior plate 352 formed substantially along the axis of the selector shaft 340. The racks are detented by two arms 354 of a shaft detent spring 356 which extends into the selector shaft. The spring 356 is keyed to sleeve 346 via slots 358 formed on opposite sides of the interior surface of the rearward end of the sleeve. Thus, shaft detent spring 356 rotates with sleeve 334. Further, it is prevented from axial movement in one direction by stop surface 360 in the sleeve which engages surfaces 361 of the detent and in the other direction by a protrusion 363 which may be provided on the inner surface of recess 338 of rear head cover 282. The spacing between the teeth of racks 350 corresponds to the spacing between the print bands 310. Hence, the selector shaft 340 will be detented at whatever print band the operator axially shifts the shaft to. As can be appreciated, the detenting of the shaft is very close to the shaft axis (which preferably approximately coincides with the axis of sleeve 334) and thus the operator is provided with a good feel as he shifts shaft 340 to a particular print band. Further, the detenting action occurs on both sides of the shaft axis in a substantially symmetrical manner to further enhance the detenting action. It is also in accordance with the invention to connect the racks 350 so that they form a single rack which is detented as the sides thereof by arms 354 of spring 356. Further, the single rack may be detented by a single detent arm which substantially extends along the shaft axis.

In order to provide the operator with an indication as to which print band has been selected, a print band indicator 362 is mounted on the selector shaft. Accordingly, a pointer 364 points to the selected print band in a known manner.

It is to be understood that the above detailed description of the various embodiments of the invention is provided by way of example only. Various details of design and construction may be modified without departing from the true spirit and scope of the invention as set forth in the appended claims.

What is claimed is:

1. Apparatus for printing and applying pressure sensitive labels carried on a release liner of supporting material comprising:

a casing having a handle;

a manually engageable hand lever disposed at the handle;

an anvil mounted with respect to the frame;

a print head mounted with respect to the frame;

means for peeling printed labels from the release liner;

label applying means for applying the printed labels;

a feed wheel;

first ratchet teeth coupled to the feed wheel;

a first pawl cooperable with the first ratchet teeth to advance the feed wheel and the release liner;

second ratchet teeth coupled to the feed wheel;

a brake for engaging the labels carried on the release liner for preventing advancement of the release liner during application of the printed labels by said label applying means, said brake including a second pawl cooperable with the second ratchet teeth to remove the brake from the labels on the release liner; and actuator means coupled to the hand lever for moving the print head to print a label and for thereafter moving the first pawl to advance the feed wheel and release liner and the second ratchet teeth, said second pawl being responsive to the movement of the second ratchet teeth to remove the brake from the labels on the release liner during advancement of the release liner.

2. Apparatus as in claim 1 where said first and second ratchet teeth are integrally connected to said feed wheel.

3. Apparatus as in claim 2 where said first and second ratchet teeth are connected to opposite sides of the feed wheel.

4. Apparatus as in claims 1 or 3 where said actuator means is integrally connected to the hand lever.

5. Apparatus as in claims 1 or 3 where said brake includes means for removing the brake prior to the advancement of the release liner.

6. Apparatus as in claim 5 where said means for removing the brake prior to advancement of the release liner includes means responsive to said actuator means for removing the brake from the labels on the release liner while the print head is being moved by the actuator means to print on a label.

7. Apparatus as in claim 5 where said brake includes manual release means extending through an opening in said casing for removing said brake from said labels on the release liner.

8. Apparatus as in claim 7 where said manual release means includes latching means for latching the brake in

BEST AVAILABLE COPY a position removed from the labels on the release liner and where said actuator means includes means for removing the latch on the brake in response to movement of the print head toward the label on the release liner.

9. Apparatus as in claims 1 or 3 including ink roller means for inking type elements of the print head, the ink roller means including an ink roll, a carrier for said ink roll including a pair of open-ended recesses, means for mounting said ink roll in the open-ended recesses, latching means mounted on said carrier for closing off the open ends of said recesses to secure the ink roll within the carrier when the latching means is in a first position and said latching means being movable to a second position which unblocks the open ends of the recesses to facilitate removal of the ink roll from the carrier and an opening in said casing through which an operator may move the latching means to its second position to thereby remove and replace the ink roll.

10. Apparatus as in claims 1 or 3 where said print head includes a plurality of print bands, a drive gear in driving engagement with each respective print band, each drive gear having a hole, the holes being generally aligned to provide an opening having a predetermined axis, a selectively shiftable and rotatable selector movable into the opening, said selector including at least one rack, detenting means disposed within said opening for detenting said rack so that the selector is releasably held in a shifted position corresponding to a selected one of said drive gears and driving means connected to said selector for driving said selected one drive gear to thereby set the print band corresponding to said selected drive gear to a predetermined position.

11. Apparatus as in claim 10 where said selector rack is disposed in the vicinity of the axis of the opening defined by the drive gear holes.

12. Apparatus as in claim 11 where the selector rack is internally disposed within the selector and the detenting means extends within the selector.

13. Apparatus as in claim 12 where the selector rack extends on both sides of the axis of the hole defined by the drive gear openings.

14. Apparatus as in claim 13 including two selector racks disposed on opposite sides of said axis.

15. Apparatus as in claim 10 including a tubular shaft extending through said hole and having a longitudinally extending slot therein, said selector shaft extending into said tubular shaft, and said driving means comprising a lug disposed on the selector shaft and extending through said slot.

16. Apparatus for printing and applying pressure sensitive labels carried on a release liner of supporting material comprising:

a casing having a handle;

a manually engageable hand lever disposed at the handle;

an anvil mounted with respect to the frame;

a print head mounted with respect to the frame;

means for peeling printed labels from the release liner;

label applying means for applying the printed labels;

a toothed feed wheel;

advancing means for advancing the feed wheel and the release liner;

ratchet teeth coupled to the feed wheel;

a brake for engaging the labels carried on the release liner for preventing advancement of the release liner during application of the printed labels by said label applying means, said brake including a pawl cooperable with the ratchet teeth to remove the brake from the labels on the release liner;

actuator means coupled to the hand lever for moving the print head to print a label and for thereafter moving the advancing means to advance the feed wheel and release liner and the ratchet teeth, said pawl being responsive to the movement of the ratchet teeth to remove the brake from the labels on the release liner during advancement of the release liner; and means for removing the brake prior to advancement of the release liner including means responsive to said actuator means for removing the brake from the labels on the release liner while the print head is being moved by the actuator means to print a label.

17. Apparatus for printing and applying pressure sensitive labels carried on a release liner of supporting material comprising:

a casing having a handle where the casing includes an opening therein;

a manually engageable hand lever disposed at the handle;

an anvil mounted with respect to the casing;

a print head mounted with respect to the casing;

means for peeling printed labels from the release liner;

label applying means for applying the printed labels;

means for advancing the labels on the release liner;

actuator means coupled to the hand lever for moving the print head to print a label and for thereafter advancing the label on the release liner; and ink roller means for inking type elements of the print head, the ink roller means including an ink roll, a carrier for said ink roll pivotable about a point fixed with respect to said casing and including a pair of open-ended recesses, means for mounting said ink roll in the open-ended recesses, the open ends of which face the opening in the casing, latching means mounted on said carrier and disposed adjacent said opening in the casing for closing off the open ends of said recesses to secure the ink roll within the carrier when the latching means is in a first position and said latching means being movable by an operator through the opening in the casing to a second position which unblocks the open ends of the recesses to facilitate removal and replacement of the ink roll from the carrier through the opening in said casing.

18. Apparatus as in claim 17 including detenting means for releasably holding said latching means in said first position.

19. Apparatus for printing and applying pressure sensitive labels carried on a release liner of supporting material comprising:

a casing having a handle;

a manually engageable hand lever disposed at the handle;

an anvil mounted with respect to the frame;

a print head mounted with respect to the frame;

means for peeling printed labels from the release liner;

label applying means for applying the printed labels;

a feed wheel;

first ratchet teeth coupled to the feed wheel;

a first pawl cooperable with the first ratchet teeth to advance the feed wheel and the release liner;

second ratchet teeth coupled to the feed wheel;

a brake for engaging the labels carried on the release liner for preventing advancement of the release liner during application of the printed labels by said label applying means, said brake including a second pawl cooperable with the second ratchet teeth to remove the brake from the labels on the release liner;

actuator means coupled to the hand lever for moving the print head to print a label and for thereafter moving the first pawl to advance the feed wheel and release liner and the second ratchet teeth, said second pawl being responsive to the movement of the second ratchet teeth to remove the brake from the labels on the release liner during advancement of the release liner; and said print head including a plurality of print bands, a drive gear in driving engagement with each respective print band, each drive gear having a hole, the holes being generally aligned to provide an opening having a predetermined axis, a selectively shiftable and rotatable selector movable into the opening, said selector including at least one rack disposed in the vicinity of the axis of the opening defined by the drive gear holes and internally disposed within the selector, detenting means disposed within said opening and extending within the selector for detecting said rack so that the selector is releasably held in a shifted position corresponding to a selected one of said drive gears and driving means connected to said selector for driving said selected one drive gear to thereby set the print band corresponding to said selected drive gear to a predetermined position.

20. Apparatus as in claim 19 where the selector rack extends on both sides of the axis of the hole defined by the drive gear openings.

21. Apparatus as in claim 20 including two selector racks disposed on opposite sides of said axis.

22. Apparatus for printing and applying pressure sensitive labels carried on a release liner of supporting material comprising:

a casing having a handle;

a manually engageable hand lever disposed at the handle;

an anvil mounted with respect to the frame;

a print head mounted with respect to the frame;

means for peeling printed labels from the release liner;

label applying means for applying the printed labels;

means for advancing the labels on the release liner;

actuator means coupled to the hand lever for moving the print head to print a label and for thereafter advancing the label on the release liner; and said print head including a plurality of print bands, a drive gear in driving engagement with each respective print band, each drive gear having a hole, the holes being generally aligned to provide an opening having a predetermined axis, a selectively shiftable and rotatable selector movable into the opening, said selector including at least one rack internally disposed within the selector, detenting means disposed within said opening and extending within the selector for detenting said rack so that the selector is releasably held in a shifted position corresponding to a selected one of said drive gears and driving means connected to said selector for driving said selected one drive gear to thereby set the print band corresponding to said selected drive gear to a predetermined position.

23. Apparatus as in claim 22 where the selector rack extends on both sides of the axis of the hole defined by the drive gear openings.

24. Apparatus as in claim 23 including two selector racks disposed on opposite sides of said axis.

25. Apparatus as in claim 22 including a tubular shaft extending through said hole and having a longitudinally extending slot therein, said selector shaft extending into said tubular shaft, and said driving means comprising a lug disposed on the selector shaft and extending through said slot.

* * * * *